US009371677B1

(12) United States Patent
Kunz

(10) Patent No.: US 9,371,677 B1
(45) Date of Patent: Jun. 21, 2016

(54) BRAKE SHOE WITH CONTACT POSTS THAT INCREASE BRAKE STRENGTH AND IMPROVE THE INTERCONNECTION BETWEEN THE BRAKE SHOE AND A COUNTERBALANCE SPRING OF A TILT-IN WINDOW

(71) Applicant: John R. Kunz, Douglassville, PA (US)

(72) Inventor: John R. Kunz, Douglassville, PA (US)

(73) Assignee: John Evans' Sons, Inc., Lansdale, PA (US)

( * ) Notice: Subject to any disclaimer, the term of this patent is extended or adjusted under 35 U.S.C. 154(b) by 82 days.

(21) Appl. No.: 14/058,537

(22) Filed: Oct. 21, 2013

Related U.S. Application Data

(63) Continuation-in-part of application No. 13/655,416, filed on Oct. 18, 2012.

(51) Int. Cl.
*E05D 13/00* (2006.01)
*E06B 3/50* (2006.01)

(52) U.S. Cl.
CPC ..... *E05D 13/1276* (2013.01); *E06B 3/50* (2013.01)

(58) Field of Classification Search
CPC ..... E05D 15/22; E05D 13/1276
USPC ..... 49/176, 181, 445–447, 453; 16/193, 16/197, 198, DIG. 16
See application file for complete search history.

(56) References Cited

U.S. PATENT DOCUMENTS

| | | | | |
|---|---|---|---|---|
| 4,718,194 | A | 1/1988 | Fitzgibbon | |
| 5,353,548 | A | 10/1994 | Westfall | |
| 5,371,971 | A * | 12/1994 | Prete | 49/380 |
| 5,414,960 | A * | 5/1995 | O'Donnell et al. | 49/177 |
| 5,463,793 | A | 11/1995 | Westfall | |
| 5,661,927 | A * | 9/1997 | Polowinczak et al. | 49/447 |
| 6,378,169 | B1 | 4/2002 | Batten et al. | |
| 6,990,710 | B2 * | 1/2006 | Kunz et al. | 16/193 |
| 7,966,770 | B1 | 6/2011 | Kunz | |
| 8,850,745 | B2 * | 10/2014 | Sofianek et al. | 49/447 |
| 2004/0006845 | A1 * | 1/2004 | Polowinczak et al. | 16/197 |
| 2005/0091791 | A1 * | 5/2005 | Kunz et al. | 16/216 |
| 2008/0120804 | A1 * | 5/2008 | Annes et al. | 16/198 |
| 2014/0259524 | A1 * | 9/2014 | Kellum et al. | 16/197 |
| 2014/0259936 | A1 * | 9/2014 | DeNormand et al. | 49/150 |

* cited by examiner

*Primary Examiner* — Katherine Mitchell
*Assistant Examiner* — Scott Denion
(74) *Attorney, Agent, or Firm* — LaMorte & Associates, P.C.

(57) ABSTRACT

A counterbalance system that is set into the guide track of a tilt-in window. A brake shoe housing is provided that has a first arm element. The brake shoe housing is connected to a coil spring within the guide track of the tilt-in window. At least one post is set into the first arm element. Each post has a free end that extends away from the first arm element. One post passes through a hole in the coil spring and forms part of the mechanical interconnection between the brake shoe housing and the coil spring. A cam is disposed within the brake shoe housing. When turned, the cam moves the first arm element, therein causing each post to be biased against the guide track. The contact between each post and the guide track inhibits movement of the brake shoe housing.

12 Claims, 5 Drawing Sheets

BRAKE SHOE WITH CONTACT POSTS THAT INCREASE BRAKE STRENGTH AND IMPROVE THE INTERCONNECTION BETWEEN THE BRAKE SHOE AND A COUNTERBALANCE SPRING OF A TILT-IN WINDOW

RELATED APPLICATIONS

This application is a continuation-in-part of U.S. patent application Ser. No. 13/655,416 filed Oct. 18, 2012.

BACKGROUND OF THE INVENTION

1. Field of the Invention

In general, the present invention relates to counterbalance systems for windows that prevent open window sashes from moving under the force of their own weight. More particularly, the present invention system relates to the structure of both the brake shoe and spring components of the counterbalance system.

2. Description of the Prior Art

There are many types and styles of windows. One of the most common types of window is the double-hung window. Double-hung windows are the window of choice for most home construction applications. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. Additionally, the sashes can be selectively tilted into the home so that the exterior of the sashes can be cleaned from within the home.

The sash of a double-hung window has a weight that depends upon the materials used to make the window sash and the size of the window sash. Since the sashes of a double-hung window are free to move up and down within the frame of a window, some counterbalancing system must be used to prevent the window sashes from constantly moving to the bottom of the window frame under the force of their own weight.

For many years, counterbalance weights were hung next to the window frames in weight wells. The weights were attached to window sashes using a string or chain that passed over a pulley at the top of the window frame. The weights counterbalanced the weight of the window sashes. As such, when the sashes were moved in the window frame, they had a neutral weight and friction would hold them in place.

The use of weight wells, however, prevents insulation from being packed tightly around a window frame. Furthermore, the use of counterbalance weights on chains or strings cannot be adapted well to tilt-in double-hung windows. Accordingly, as tilt-in windows were being developed, alternative counterbalance systems were developed that were contained within the confines of the window frame yet did not interfere with the tilt action of the tilt-in windows.

Modern tilt-in double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl frame windows. As such, the prior art concerning vinyl frame windows is herein addressed.

Vinyl frame, tilt-in, double-hung windows are typically manufactured with guide tracks along the inside of the window frame. Brake shoe assemblies, commonly known as "shoes" in the window industry, are placed in the guide tracks and ride up and down within the guide tracks. Each sash of the window has two tilt pins or tilt posts that extend into the shoes and cause the shoes to ride up and down in the guide tracks as the window sashes are opened or closed.

The shoes contain a brake mechanism that is activated by the tilt post of the window sash when the window sash is tilted inwardly away from the window frame. The shoe therefore locks the tilt post in place and prevents the base of the sash from moving up or down in the window frame once the sash is tilted open. Furthermore, the brake shoes are attached to coil springs inside the guide tracks of the window assembly. Coil springs are constant force springs, made from wound lengths of metal ribbon. The coil springs supply the counterbalance force needed to suspend the weight of the window sash.

Small tilt-in windows have small relatively light window sashes. Such small sashes may only require a single coil spring on either side of the window sash to generate the required counterbalance forces. However, due to the space restrictions present in modern tilt-in window assemblies, larger springs cannot be used for heavier window sashes. Rather, multiple smaller coil springs are ganged together to provide the needed counterbalance force. A large tilt-in window sash may have up to eight coil springs to provide the needed counterbalance force.

Prior art shoes that contain braking mechanisms and engage counterbalance coil springs are exemplified by U.S. Pat. No. 6,378,169 to Batten, entitled Mounting Arrangement For Constant Force Spring Balance; U.S. Pat. No. 5,463,793 to Westfall, entitled Sash Shoe System For coil Spring Window Balance; and U.S. Pat. No. 5,353,548 to Westfall, entitled coil Spring Shoe Based Window Balance System.

Prior art counterbalance assemblies that use cams as a braking mechanism are exemplified by U.S. Pat. No. 4,718,194 to Fitzgibbon. Such systems are also exemplified by the applicant's earlier patent; U.S. Pat. No. 7,966,770 to Kunz.

In a window counterbalance system, the pull of the coil springs counter the weight of a window sash. However, when the window sash is tilted inward for cleaning, or removed altogether, the pull of the coil springs suddenly is much greater than the weight being countered. To prevent the pull of the coil springs from moving the window sash when it is tilted, the shoes must contain a strong brake mechanism that locks the shoes in place.

A need therefore exists in the field of vinyl, tilt-in, double-hung windows, for a counterbalance system with a brake shoe that firmly engages one or more coils springs, yet can better lock in position against the force of those coil springs. This need is met by the present invention as described and claimed below.

SUMMARY OF THE INVENTION

The present invention is a counterbalance system that is set into the guide track of a tilt-in window. The counterbalance system utilizes a coil spring. A brake shoe housing is provided that has a first arm element. The brake shoe housing is connected to the coil spring within the guide track of the tilt-in window.

At least one post is set into the first arm element. Each post has a free end that extends away from the first arm element. One post passes through a hole in the coil spring and forms part of the mechanical interconnection between the brake shoe housing and the coil spring.

A cam is disposed within the brake shoe housing. When turned, the cam moves the first arm element, therein causing each post to be biased against the guide track. The contact between each post and the guide track dramatically increases friction, therein inhibiting the brake shoe housing from moving within the guide track.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

The claimed features of the present invention brake shoe can be incorporated into many window counterbalance designs. However, the embodiments illustrated show only two exemplary embodiments of the counterbalance system for the purpose of disclosure. The embodiments illustrated are selected in order to set forth two of the best modes contemplated for the invention. The illustrated embodiments, however, are merely exemplary and should not be considered a limitation when interpreting the scope of the appended claims.

Figure 1:
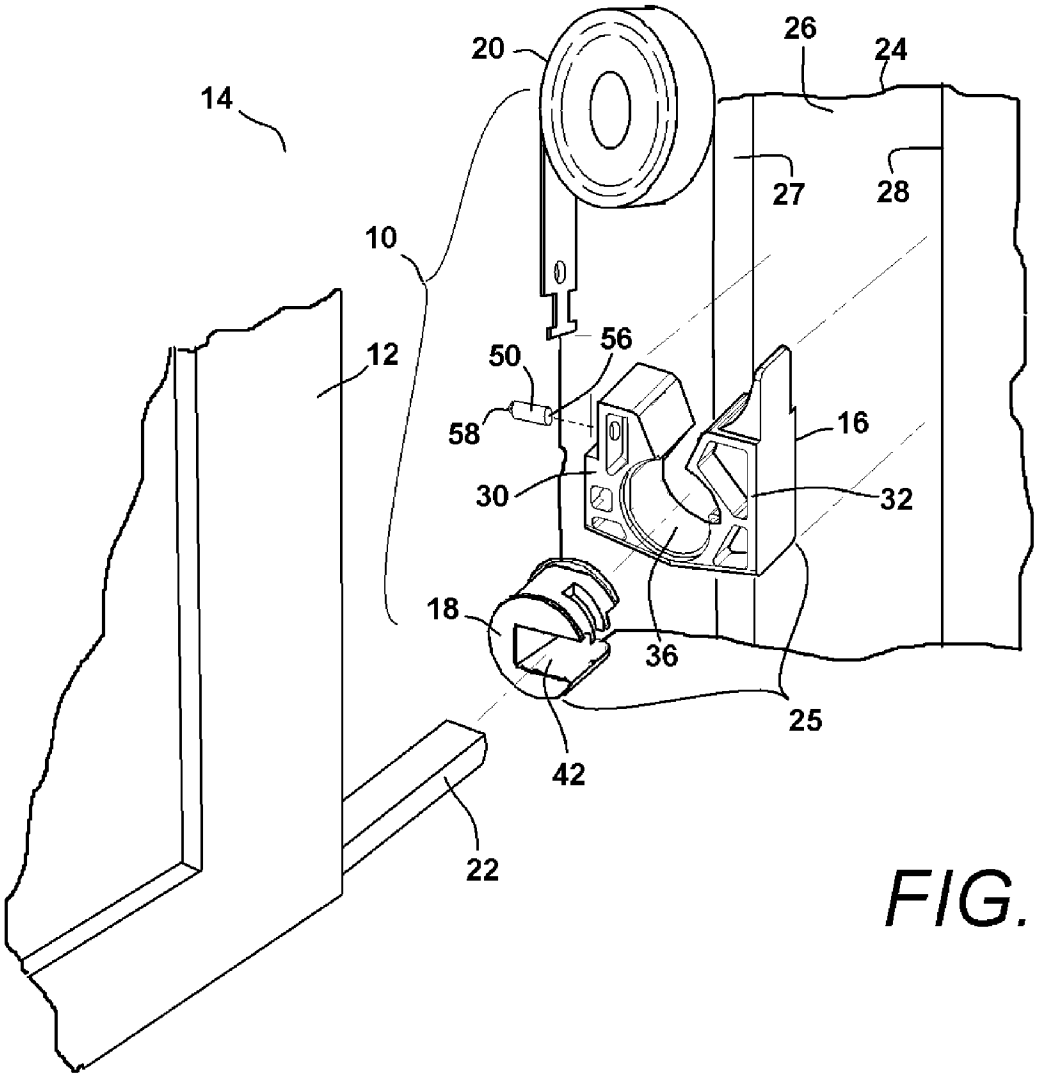
FIG. 1 is an exploded perspective view of a section of a tilt-in window assembly containing a counterbalance system in accordance with the present invention.
Figure 2:
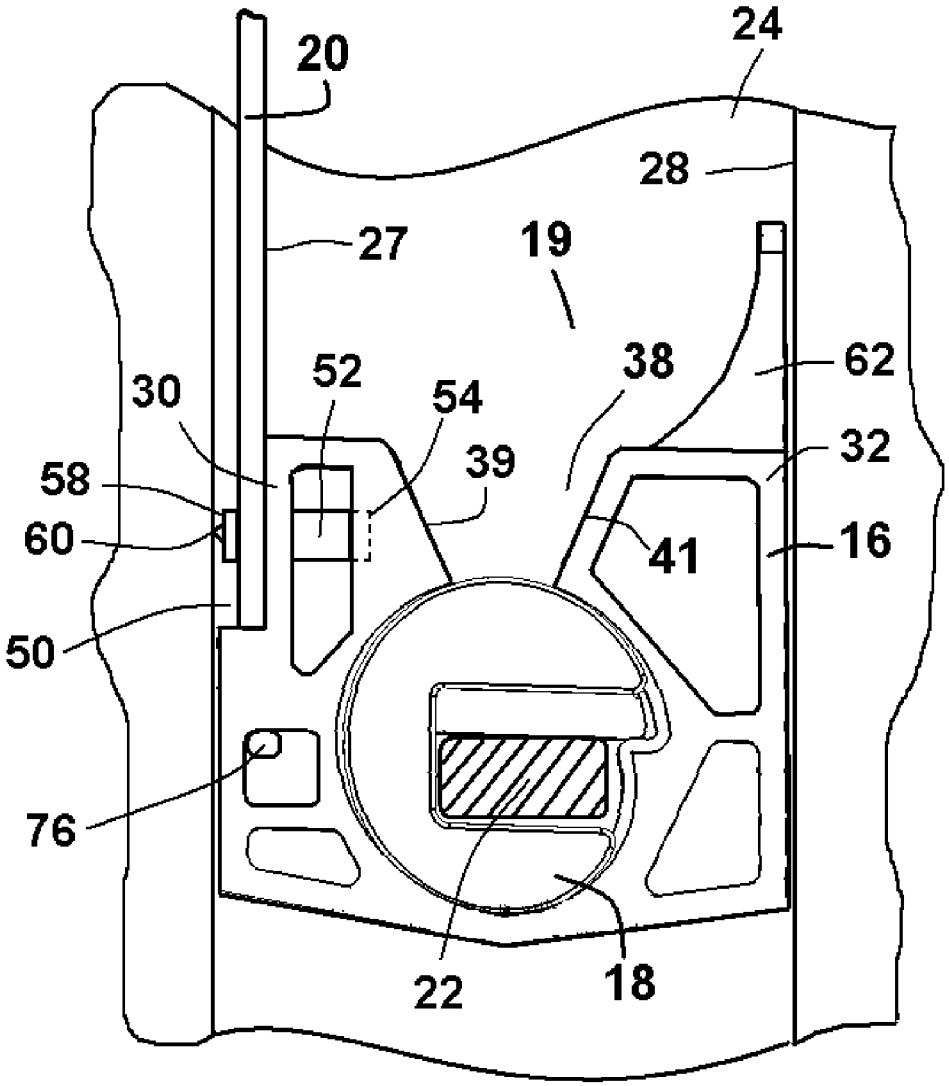
FIG. 2 is an end view of the embodiment of the counterbalance system shown in FIG. 1, shown in an unlocked condition.
Figure 3:
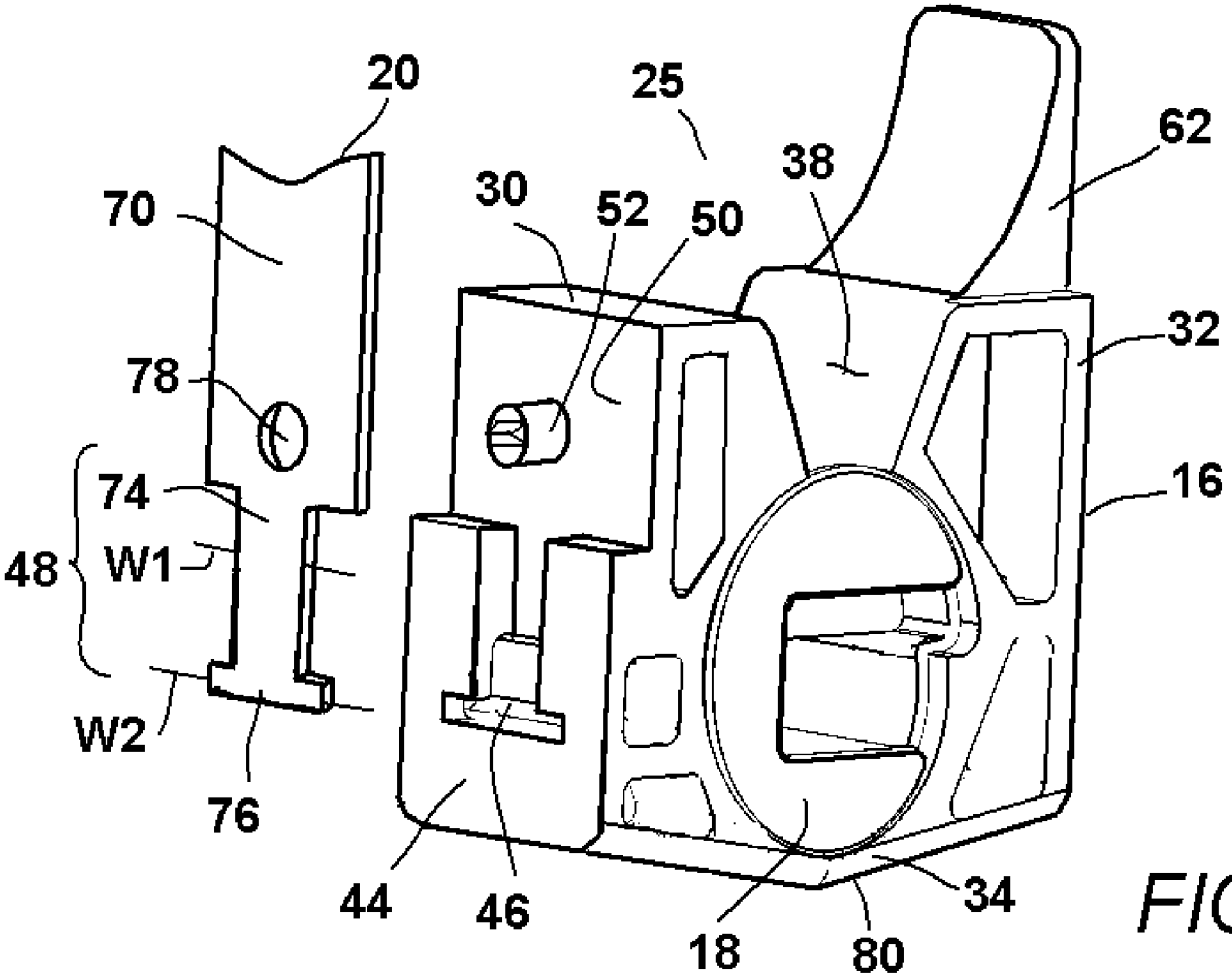
FIG. 3 is a perspective view of the brake shoe assembly and the free end of the coil spring to show interconnection features.

Referring to FIG. 1, in conjunction with both FIG. 2 and FIG. 3, there is shown an exemplary embodiment of a counterbalance system 10 that is used to counterbalance the sashes 12 contained within a window assembly 14. The counterbalance system 10 utilizes a brake shoe housing 16, a cam element 18, and at least one coil spring 20 on either side of each window sash 12. The brake shoe housing 16 engages a tilt post 22 that extends from the bottom of the window sash 12. As the window sash 12 is opened and closed, the brake shoe housing 16 travels up and down in vertical guide tracks 24. It will be understood that each window sash 12 typically utilizes two counterbalance systems on opposite sides of the sash 12. However, for the sake of simplicity and clarity, only one counterbalance system 10 is illustrated.

The brake shoe housing 16 receives the cam element 18 to form a brake shoe assembly 25. The brake shoe assembly 25 rides up and down in its guide track 24. The brake shoe assembly 25 is pulled upwardly within the guide track 24 by at least one coil spring 20. The guide track 24 has a rear wall 26 and two side walls 27, 28. The brake shoe assembly 25 is sized to be just narrow enough to fit between the side walls 27, 28 of the guide track 24 without causing excessive contact with the guide track 24 as the brake shoe assembly 25 moves up and down with the window sash 12.

The brake shoe housing 16 is plastic and is unistructurally molded as a single unit that requires no assembly. The brake shoe housing 16 is generally U-shaped, having a first arm element 30 and a second arm element 32 that are interconnected by a thin bottom section 34. In the shown embodiment, the coil spring 20 attaches to the first arm element 30. In the preferred embodiment, the second arm element 32 has a length that is at least twenty-five percent longer than that of the first arm element 30.

A generally circular cam opening 36 is formed between the first arm element 30, the second arm element 32 and the bottom section 34. Above the cam opening 36, the first arm element 30 and the second arm element 32 are separated by a gap space 38. The first arm element 30 has a first sloped surface 39 that faces the gap space 38. Likewise, the second arm element 32 has a second sloped surface 41 that faces the gap space 38. Taken together, the first sloped surface 39 and the second sloped surface 41 diverge away from each other as they ascend above the cam opening 36. The result is that the gap space 38 has tapered sides that lead into the cam opening 36.

During manufacture, the cam element 18 is inserted into the cam opening 36 by forcing the cam element 18 into the gap space 38 between the first arm element 30 and the second arm element 32 of the brake shoe housing 16. When pressed into the gap space 38, the cam element 18 spreads the first arm element 30 and the second arm element 32 apart. This is achieved by the elastic flexing of the thin bottom section 34 of the brake shoe housing 16, which acts as a living hinge.

The first arm element 30 has a side surface 44. A receptacle 46 is formed in the side surface 44. The receptacle 46 is sized to receive and retain the shaped head 48 of the coil spring 20. A relief 50 is formed in the side surface 44 of the first arm element 30 just above the receptacle 46. A sloped step 53 is provided between the receptacle 46 and the relief 50 to provide a smooth surface transition between the receptacle 46 and the relief 50.

A post 52 is set into the side surface 44 of the first arm element 30 within the relief 50. The post 52, however, is not molded as part of the brake shoe housing 16. Rather, the post 52 is preferably made of a harder material, such as a polycarbonate plastic, a fiberglass reinforced plastic, or a metal. Steel is the preferred material. The post 52 sits in a bore 54 and engages the bore 54 with a friction press-fit. Alternatively, the posts 52 can be glued into place and/or molded into the material of the brake shoe housing 16. The length of the post 52 is such that the post 52 extends from the brake shoe housing 16 as a cantilever. The post 52 has a first end 56 that passes into the bore 54 and an opposite free end 58 that extends from the brake shoe housing 16 as a cantilever. The free end 58 of the post 52 extends across the relief 50 and terminates in the same plane as the outside of the slot receptacle 46. The free end 58 of the post 52 can be blunt. However, in the exemplary embodiment shown, the free end 58 of the post 52 is formed into a salient edge 60.

Figure 4:
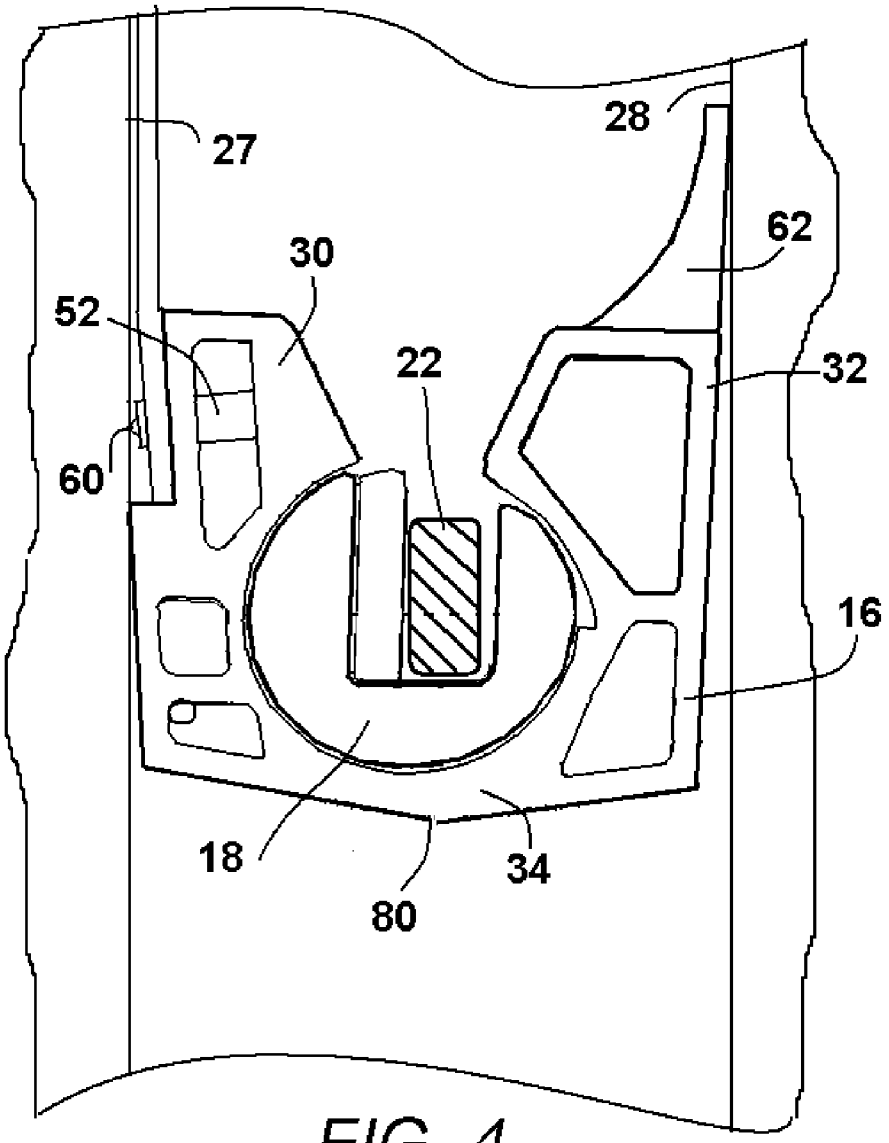
FIG. 4 is an end view of the embodiment of the counterbalance system shown in FIG. 1, shown in a locked condition.

A tilt post receiving slot 42 is formed in the cam element 18. The tilt post receiving slot 42 receives the tilt post 22 from the window sash 12. Referring to FIG. 4 in conjunction with FIGS. 1,2 and 3, it can be seen that when the window sash 12 is tilted inwardly, the tilt post 22 of the window sash 12 causes the cam element 18 to turn inside the cam opening 36. The cam element 18 spreads the first arm element 30 apart from the second arm element 32 of the brake shoe housing 16. As the cam element 18 spreads the brake shoe housing 16, the brake shoe housing 16 flexes in its bottom section 34. The first arm element 30 and the second arm element 32 are displaced and are biased against the side walls 27, 28 of the track 24.

Furthermore, the salient edge 60 of the post 52 is biased against the side wall 27 of the guide track 24. This contact dramatically increases the forces needed to slide the brake shoe assembly 25 within the guide track 24. The result is that the brake shoe assembly 25 becomes locked in position within the guide track 24 for as long as the window sash 12 remains tilted.

FIG. 2 shows the brake shoe assembly 25 in its unlocked configuration, where it is free to move in the guide track 24. FIG. 4 shows the brake shoe assembly 25 in its locked configuration, where the window sash 12 is tilted and the brake shoe housing 16 is spread and locked in the guide track 24.

Referring to FIGS. 1, 2, 3, and 4 in unison, it can be seen that the coil spring 20 attaches to the first arm element 30 of the brake shoe housing 16. When the brake shoe assembly 25 is in its unlocked configuration, the coil spring 20 pulls upwardly on the brake shoe housing 16. This causes the brake shoe housing 16 to have a rotational bias in the clockwise direction as it travels up and down the guide track 24. To prevent the brake shoe housing 16 from cocking in the clockwise direction, the second arm element 32 is provided with an extension 62. The extension 62 elongates the second arm element 32 and provides more surface contact with the side wall 28 of the window guide track 24. This extended contact inhibits the brake shoe assembly 25 from binding in the guide track 24.

The coil spring 20 is made of a wound ribbon 70 of steel. The shaped head 48 of the coil spring 20 is formed just before its free end 72. The shaped head 48 is T-shaped having a narrow neck 74 that leads to a wider leader 76. The narrow neck 74 has a first width W1. The leader 76 has a larger second width W2.

A post hole 78 is formed through the ribbon 70 just before the ribbon 70 narrows into the shaped head 48. The diameter of the post hole 78 is just slightly larger than the diameter of the post 52 set into the first arm element 30 of the brake shoe housing 16.

The shaped head 48 of the coil spring 20 interconnects with the first arm element 30 of the brake shoe housing 16. The first arm element 30 of the brake shoe housing 16 is specially designed to receive both the shaped head 48 of the coil spring 20 and a length of the ribbon 70 just before the shaped head 48 so as to reduce fatigue stresses in the coil spring 20.

When the coil spring 20 is engaged with the brake shoe housing 16, the shaped head 48 of the coil spring 20 enters the receptacle 46. This aligns the post hole 78 in the coil spring 20 to the post 52 on the brake shoe housing 16. The post 52 passes into the post hole 78. The connection between the coil spring 20 and both the receptacle 46 and the post 52 mechanically interconnects the coil spring 20 with the brake shoe housing 16. Once mechanically engaged, a length of the ribbon 70 proximate the shaped head 48 lay flush against the first arm element 30 along the relief 50. The length of the ribbon 70 in contact with the relief 50 is preferably at least as long as the length L1 of the shaped head 48. As a consequence, the receptacle 46, the post 52, and the relief 50 combine to form an anchor structure that engages both the shaped head 48 of the coil spring 20 and the length of ribbon 70 behind the shaped head 48.

The neck 74 of the shaped head 48 is much narrower than the remaining ribbon 70 of the coil spring 20. As such, as a window sash 12 (FIG. 1) is opened and closed, changing tension forces and even some compression forces can be experienced by the coil spring 20. These changing forces create stresses that tend to concentrate in the shaped head 48 of the coil spring 20. The stresses fatigue the material of the coil spring 20 and can eventually cause the shaped head 48 to break. By engaging the coil spring 20 with the post 52 and supporting both the shaped head 48 and the segment of ribbon 70 behind the shaped head 48, the stress forces are prevented from concentrating in the shaped head 48. The result is that the coil spring 20 experiences far less fatigue forces and therefore has a much longer operating life.

In order to accommodate both the receptacle 46 and the relief 50, the receptacle 46 must be positioned low on the side surface 44 of the first arm element 30. The brake shoe housing 16 has a bottom surface 80 under the bottom section 34. The cam opening 36 in the brake shoe housing 16 has a center point CP a predetermined distance D1 above the bottom surface 80. The receptacle 46 is positioned on the first arm element 30 at a height above the bottom surface 80 that is no higher than that of the center point CP of the cam opening 36.

Attaching the coil spring 20 to the brake shoe housing 16 at this low point of attachment has secondary advantages. The shaped head 48 of the coil spring 20 is generally horizontally aligned with the center of the cam element 18. Since the brake shoe housing 16 can rotate relative the cam element 18, this horizontal alignment minimizes the rotational torque experienced by the brake shoe housing 16. As a result, the cocking forces on the brake shoe housing 16 are minimized.

Figure 5:
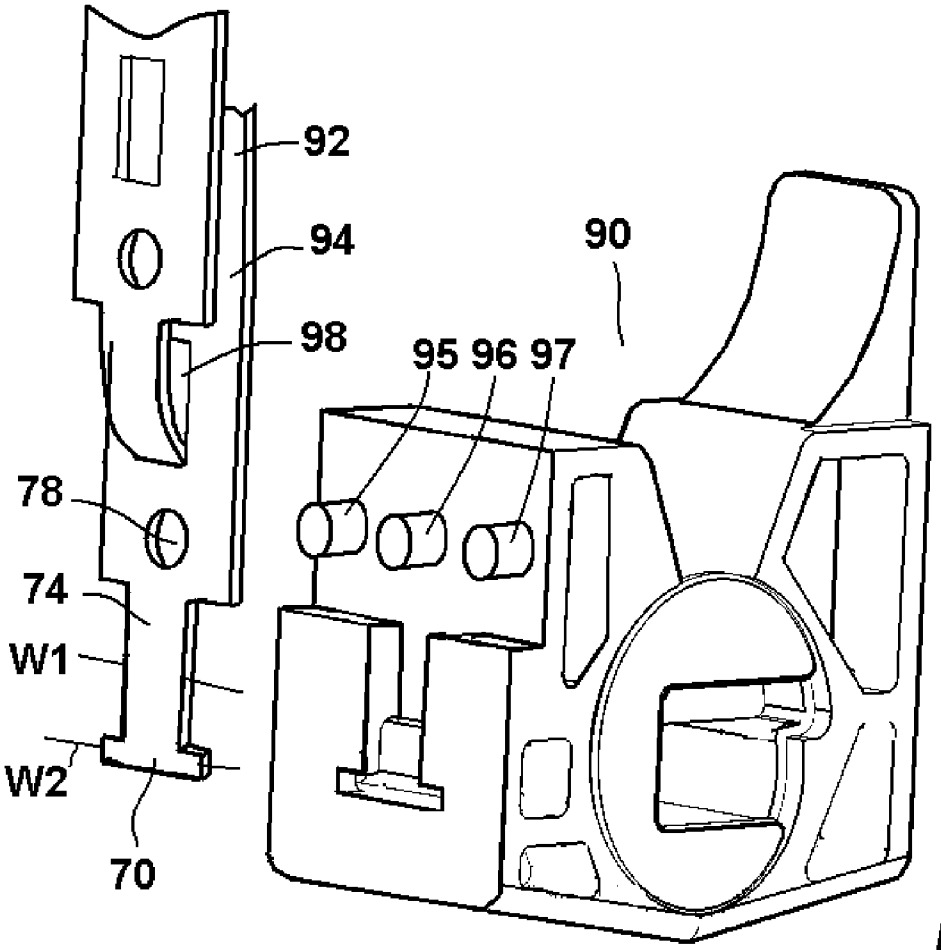
FIG. 5 shows an alternate embodiment of both a brake shoe assembly and a coil spring.

In the embodiment of FIGS. 1 through 4, a brake shoe assembly 25 is shown where the brake shoe housing 16 is generally the same width as the ribbon 70 of the coil spring 20. However, this in not always the case. Referring to FIG. 5, an alternate embodiment of the present invention is shown that presents an alternate embodiment for the brake shoe housing 90 and an alternate embodiment for the coil spring 92. In this alternate embodiment, the brake shoe housing 90 is wider than the ribbon 94 of the coil spring 92. In such a scenario, a plurality of posts 95, 96, 97 can be set into the brake shoe housing 90. The posts 95, 96, 97 are all parallel and have the same length. As such, they all terminate in the same plane and all are the same distance from either the top or the bottom of the brake shoe housing 90.

When the coil spring 92 is attached to the brake shoe housing 90, the post hole 78 in the coil spring 92 engages the center post 96 from the plurality of posts. The remaining posts 95, 97 project along the sides of the coil spring 92. The use of multiple posts 95, 96, 97 increases the contact points with the side wall of the vertical guide track when the brake shoe assembly is in its locked configuration.

In all previous embodiments, a single coil spring engages the brake shoe. However, if a window sash is particularly large and/or heavy, multiple coil springs may be ganged together. In FIG. 5, it can be seen that the coil spring 92 is modified so that multiple coil springs 92, can be ganged together. The coil spring 92 has the same shaped head 48 as was previously described. Thus, the same reference numbers are used to describe the features of the shaped head 48. The shaped head 48 has a narrowed neck 74 with a wide leader 76. The narrow neck 74 has a width W1. The leader 76 has a wider width W2. The coil spring 92 also has the post hole 78 formed above the shaped head 48, as was previously described. The modification that distinguishes the coil spring 92 is the addition of a slot opening 98 in the ribbon 94 of the coil spring 92 above the post hole 78. The slot opening 98 has a width W3 that is at least as wide as the width W1 of the narrow neck 74, but narrower than the width W2 of the leader 76. This enables the shaped head 48 from a first coil spring 92 to mechanically engage a second coil spring by passing the shaped head 48 of one coil spring 92 through the slot opening 98 of a second coil spring. This gang connection can be used to join multiple coil springs together.

It will be understood that the embodiments of the present invention counterbalance system that are described and illustrated herein are merely exemplary and a person skilled in the art can make many variations to the embodiment shown without departing from the scope of the present invention. All such variations, modifications, and alternate embodiments are intended to be included within the scope of the present invention as defined by the appended claims.

What is claimed is:

1. A counterbalance system set in a guide track of a tilt-in window, said system comprising:

a coil spring having a ribbon that terminates with a shaped head, wherein a hole is formed through said ribbon proximate said shaped head;

a brake shoe housing having a first arm element and a second arm element, wherein a receptacle is disposed in said first arm element that receives and retains said shaped head of said coil spring, therein interconnecting said coil spring to said brake shoe housing;

a non-rotatable post set into said first arm element, said post having a free end that extends away from said first arm element, wherein said post extends through said hole in said ribbon of said coil spring; and a cam supported within said brake shoe housing, wherein said cam spreads said first arm element and said second arm element when said cam is turned, therein causing said post to be biased against the guide track and inhibit said brake shoe housing from moving within the guide track.

2. The system according to claim 1, further including a relief formed in said first arm element proximate said receptacle, wherein said coil spring extends through said relief as said shaped head is received within said receptacle.

3. The system according to claim 2, wherein said post extends from said first arm element within said relief.

4. The system according to claim 1, wherein said free end of said post has a salient edge formed thereon.

5. The system according to claim 1, wherein said post is metal.

6. A counterbalance system set in a guide track of a tilt-in window, said system comprising:

a coil spring that terminates with a shaped head;

a hole formed through said coil spring proximate said shaped head;

a brake shoe housing having a receptacle formed therein, wherein said receptacle receive and retains said shaped head of said coil spring, therein interconnecting said coil spring to said brake shoe housing;

a non-rotatable post extending from said brake shoe housing and through said hole in said coil spring, said post having a free end that extends away from said brake shoe housing;

a cam supported within said brake shoe housing, wherein said cam expands said brake shoe housing when turned, therein causing said post to be biased against the guide track and inhibit said brake shoe housing from moving within the guide track.

7. The system according to claim 6, wherein said free end of said post has a salient edge formed thereon.

8. The system according to claim 6, wherein said at post is metal.

9. The system according to claim 6, further including a relief formed in said brake shoe housing proximate said receptacle, wherein said coil spring extends through said relief as said shaped head is received within said receptacle.

10. A counterbalance system set in a guide track of a tilt-in window, said system comprising:

a coil spring having a free end and a hole formed through said coil spring proximate said free end;

a plastic brake shoe housing, wherein said free end of said coil spring is coupled to said brake shoe housing, therein interconnecting said coil spring to said brake shoe housing;

a non-rotatable first post set into said brake shoe housing, said first post having a second free end that extends away from said brake shoe housing through said hole in said coil spring;

a cam that spreads said brake shoe housing when turned within said brake shoe housing, therein causing said first post to be biased against the guide track and inhibit said brake shoe housing from moving within the guide track.

11. The system according to claim 10, wherein said first post is metal.

12. The system according to claim 10, further including a second post extending from said brake shoe housing adjacent said first post, wherein said first post and said second post are parallel and both have equal length.

* * * * *